US007295786B2

(12) United States Patent
Brinsley

(10) Patent No.: US 7,295,786 B2
(45) Date of Patent: Nov. 13, 2007

(54) SYSTEM FOR MANAGING A DIGITAL PRINTER HAVING ACTIVE AND INACTIVE OPERATIONAL MODES

(75) Inventor: Annmarie Brinsley, Stevenage (GB)

(73) Assignee: Xerox Corporation, Stamford, CT (US)

( * ) Notice: Subject to any disclaimer, the term of this patent is extended or adjusted under 35 U.S.C. 154(b) by 333 days.

(21) Appl. No.: 11/215,486

(22) Filed: Aug. 30, 2005

(65) Prior Publication Data

US 2007/0047993 A1 Mar. 1, 2007

(51) Int. Cl.
*G03G 15/00* (2006.01)

(52) U.S. Cl. ..... 399/9; 399/16; 399/38; 399/70; 399/75

(58) Field of Classification Search ..... 399/9, 399/16, 38, 48, 69, 70, 75–77, 82
See application file for complete search history.

(56) References Cited

U.S. PATENT DOCUMENTS 6,252,681 B1 6/2001 Gusmano et al.
6,805,502 B2 10/2004 Rai et al.
6,819,445 B1 11/2004 Stevenson et al.

*Primary Examiner*—William J. Royer
(74) *Attorney, Agent, or Firm*—R. Hutter

(57) ABSTRACT

A digital printer is operable in an inactive mode, such as a sleep mode or a cycle-in mode, and an active mode. In response to receiving a first print request, the digital printer delays beginning switching from the inactive mode to the active mode, for a delay period of predetermined duration. In response to receiving a second print request during the delay period, the digital printer begins switching from the inactive mode to the active mode substantially immediately. The delay increases opportunities for processing multiple print requests within one switching to the active mode.

14 Claims, 2 Drawing Sheets

SYSTEM FOR MANAGING A DIGITAL PRINTER HAVING ACTIVE AND INACTIVE OPERATIONAL MODES

TECHNICAL FIELD

The present disclosure relates to digital printing apparatus, such as printers and copiers.

BACKGROUND

Copiers, printers, and other multifunction machines, such as including scanning and facsimile capabilities, are familiar in offices. (As used herein, all such machines will be generically called "printers.") A digital printer is typically a machine having both hardware and software aspects. Various of these aspects mandate that the machine undergo a distinct time period between the machine being turned on or otherwise requested to operate and the machine being ready to output prints. Among possible software aspects may be a need for an internal processor to "boot up" or otherwise become active; or an interpreter or equivalent program to process incoming image data to make the data directly useable by the hardware. Among possible hardware aspects are activating any number of motors or drives, such as to draw a print sheet into a position to receive an image. In the case of xerographic or electrostatographic printers, there is typically an appreciable "warm-up" time in which a fuser is brought to a necessary temperature, and/or a charging device is brought to a necessary potential. In the case of an ink-jet printer, there is typically a warm-up time in which, for instance, lines or channels for conveying liquid ink are primed, or a solid ink stick is partially melted to yield a useable quantity of liquid ink. In the case of an input scanner, which is usually part of a digital copier, there is typically a necessary warm-up time for an illumination lamp to reach a necessary luminescence.

It is generally known, in the office equipment industry, to provide systems by which a printer can have active and inactive modes. Clearly, a printer will be consuming more energy during an active state than an inactive state. In many cases, the warm-up time (whether literal or figurative) of a printer is itself a major consumer of time and energy, and therefore there is a desire to lessen the number of times a printer is requested to "wake up" in the course of a day.

U.S. Pat. Nos. 6,252,681; 6,805,502; and 6,819,445 propose methods of operating digital printers to enhance long-term performance.

SUMMARY

According to one aspect, there is provided a method of operating a digital printer, the digital printer accepting data relating to a document to be printed, and outputting a print related to the data, the digital printer being operable in an inactive mode and an active mode. In response to receiving a first print request, the digital printer delays beginning switching from the inactive mode to the active mode, for a delay period of predetermined duration. In response to receiving a second print request during the delay period, the digital printer begins switching from the inactive mode to the active mode substantially immediately.

DETAILED DESCRIPTION

Figure 1:
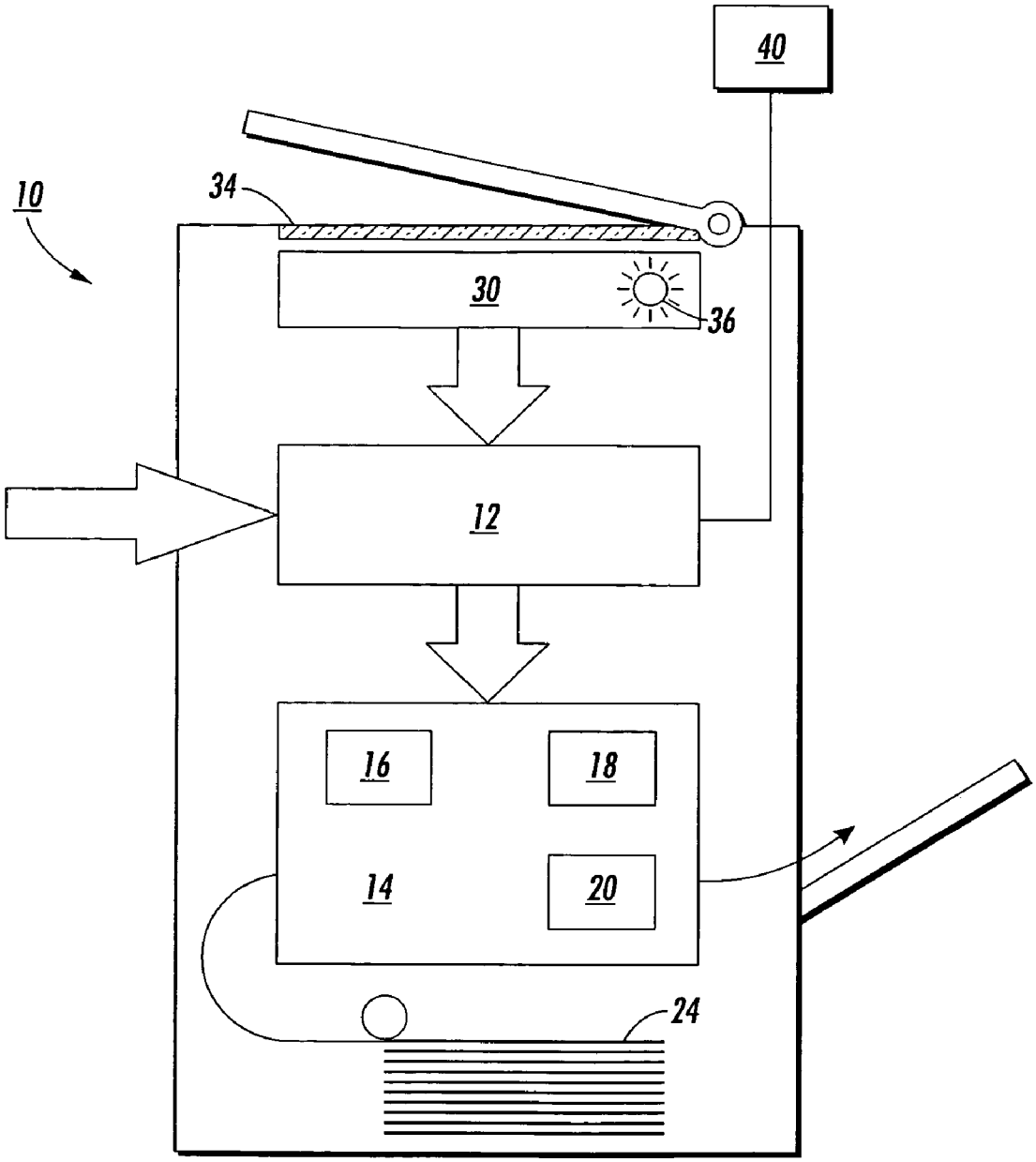
FIG. 1 is a simplified elevational view of a copier/printer.

FIG. 1 is a simplified elevational view of a copier/printer, referred to generally as printer 10. (As used herein, the word "printer" shall apply to any machine that outputs prints based on image data from any source, including copiers, facsimile machines, and multi-function devices.) The printer 10 includes a control system 12, which accepts image data from an external source, such as a network. Control system 12 can include means, such as including a memory, for retaining image data, such as when multiple jobs or other print requests are entered into the control system 12. Control system 12 typically includes one or more processors, along with ancillary chips such as for memory. Such processors may require an appreciable amount of time to "boot up" or otherwise become able to process data.

Control system 12 is operative of what can generally be called a "print engine" 14, that can be of any type familiar in the art of office equipment. A print engine can be defined as any hardware that can be controlled to create a desired image on a sheet. Most types of print engine include at least one motor, such as for moving a sheet relative to the print engine; such a motor is indicated in a general form as 16. This motor 16 can be generally considered to be able to position a sheet drawn from a stack such as 24 to receive an image from the print engine 14. If the print engine 14 is xerographic, the engine will further include at least one device or member, such as a corona device, development unit, or transfer device, which must be brought to a predetermined potential in order to operate; such a member is generally indicated as charge device 18. If the print engine 14 is of another type, such as ink-jet of some type, there is typically some heating device, here generally indicated as 20, which must be brought to a predetermined temperature to operate. Even in a typical xerographic printer, a heating device in the form of a fuser is typically employed.

Also associated with control system 12 is a scanner 30, for recording image data from a hard-copy original such as placed on a platen 34 or run through a document handler (not shown). Many scanners include an illumination lamp 36, which must reach a certain brightness in order to operate. The image data recorded at scanner 30 is retained within control system 12, for substantially instant printing through print engine 14, when the printer 10 is operating as a copier. There is typically also provided at the printer 10 a user interface 40, such as in the form of a button-pad or touch-screen, by which a human user near the printer can enter commands (e.g., how many copies to be printed, reduction/enlargement, stapling, etc.).

As mentioned above, various hardware elements of a printer 10, such as most typically motor 16, charge device 18, heating device 20, and/or illumination device 36, require an appreciable amount of time to change from a "inactive" mode to an active mode, in which the elements are ready for outputting prints. In practice, there are two general types of active/inactive modes. It is known in the art of office equipment to control a printer to operate in what is generally called a "sleep" or "energy-saving" mode, in which, for example, after a period of about 30 minutes without receiving a new job to be printed, the fuser, and perhaps the corotrons or other charged members, are shut down. When a print job is subsequently sent to the printer, the fuser and charge devices must literally "warm up". To warm up from sleep mode typically takes on the order of one to two minutes.

Another type of active/inactive mode relates specifically to the starting of motors within the printer, and can be called "cycle in/cycle out" time. In a typical practical xerographic printer, the main motor such as 16, developer module such as including a charge device 18, etc. start working about 0.5 seconds before starting to feed the paper from stack 24, which then takes about three seconds to get to the location within print engine 14 where an image is transferred or conveyed to the sheet. The placing of the image on the sheet takes about one second for a 60 page-per-minute machine and then takes about three seconds to feed to the output tray. The efficiency is 1 second of printing out of 7.5 total seconds of operation from a "standing start"; this means that 1/7.5=13.3% of the time to run the job is actually spent placing an image on the sheet and almost 87% is wasted time. If two jobs are stacked together and run with one "standing start" of the motors, the imaging time is two seconds out of an overall run time of 8.5 seconds for an efficiency of 23.5%.

It will be noted that the cycle-in time is typically on the order of three to ten seconds, while the warm-up time is on the order of one to two minutes. In a practical application, the two types of inactive/active modes are qualitatively different, as warm-up time from sleep or energy-saving mode requires heating and/or charging (which can involve heating) of a member such as 18, while cycle-in time is mainly directed to starting at least one motor such as 16 and positioning a sheet to receive an image from a print engine 14. Also, sleep modes are typically designed with an emphasis on energy efficiency, while cycle-in/cycle-out times are considered mainly from the standpoint of time efficiency.

Figure 2:
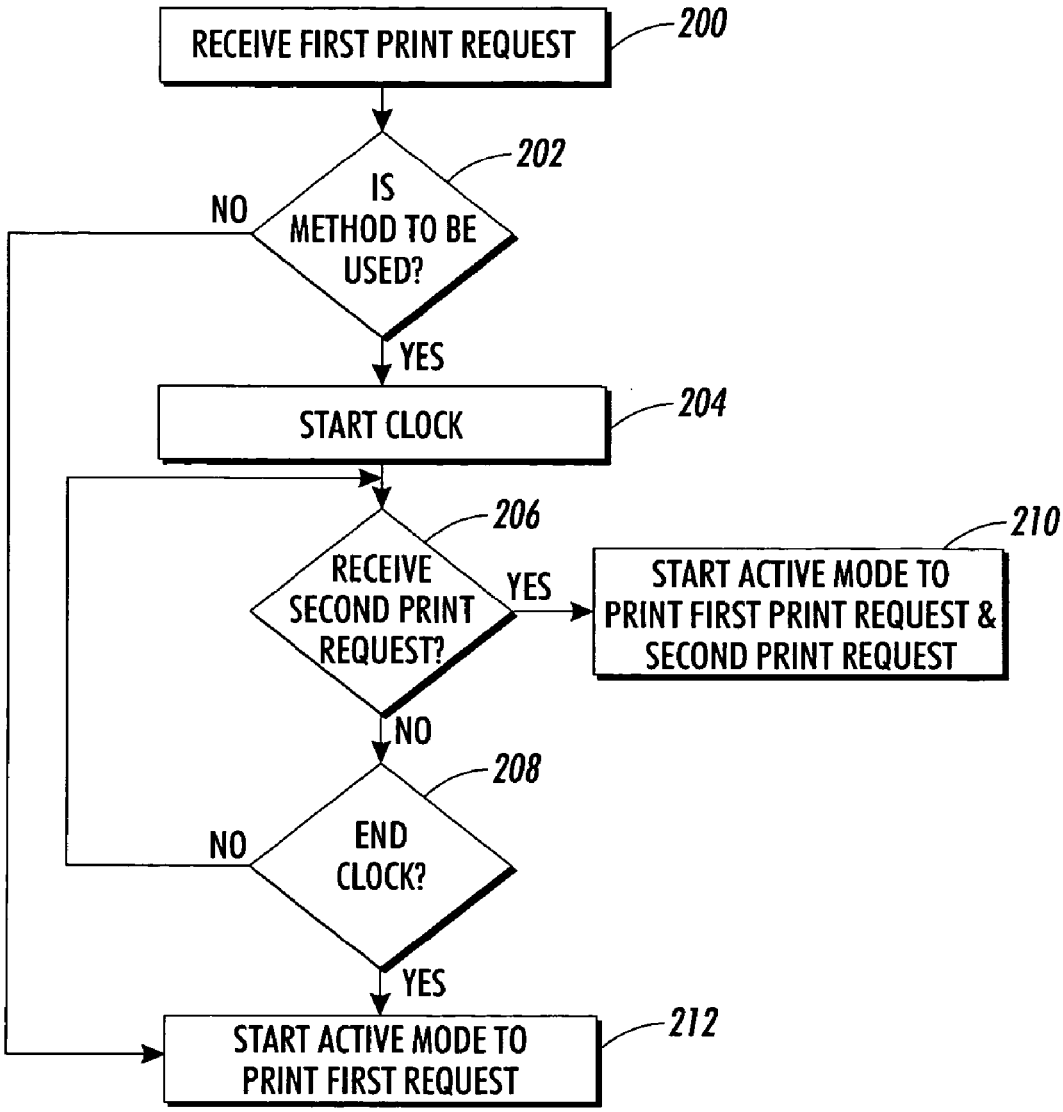
FIG. 2 is a flowchart illustrating an aspect of a method of controlling a printer.

FIG. 2 is a flowchart describing an operation of control system 12. According to an embodiment, control system 12 operates to identify opportunities to combine jobs or print requests in time, to reduce the number of changes between active and inactive modes, and thereby improve the efficiency (in a time and/or energy sense) of the printer 10.

At some time while it is in an inactive mode, the control system 12 receives a first print job (step 200). First it must be determined that the printer is in an operational mode in which the method is desirable to be used (step 202); this step will be described in detail below. If the method is desirable to be used, upon receiving the first print job, a clock is in effect started (step 204). The printer 10, as controlled by control system 12, will not begin changing from inactive to active mode (of either the warm-up or cycle-in type) until the clock reaches a time limit of predetermined duration, unless another print job is received during the duration (steps 206 and 208). If a second print job is received during the duration, the control system substantially instantly enters an active mode, and the first print job and second print jobs are printed in succession (step 210). If no second job is received before the clock ends, the first job is printed by itself (step 212).

The underlying operational theory of effectively delaying the beginning of changing from an inactive to an active mode until two jobs are accumulated is to reduce the number of times the mode must change over a period of time. Ideally, a number of jobs or other print requests should be clumped together closely in time following a single cycle-in or warm-up period. The purpose of the delay is to have the control system await an opportunity to concatenate a plurality of jobs over time. The duration of the delay should be selected so that the first job will be printed (if no second job arrives) before a significant customer dissatisfaction occurs. In one practical context involving cycle-in times, an effective duration is about fifteen seconds, or more broadly in a range between ten and thirty seconds. A duration can be programmed in non-volatile memory and be changed as per user preference, or in response to some control algorithm.

A copy job requested through user interface 40 may count as a second print job in the method of FIG. 2, although any change from inactive to active mode may have to take into account an amount of time for an illumination lamp such as 36 to reach a predetermined brightness before exposing an image placed on platen 34.

Returning to step 202, there are many factors that may be used to determine whether to use the delay described in the method, and also to select the predetermined duration of the delay. Among the possible factors are: the distribution and frequency of jobs received in a preceding period, such as an hour; the time of day; the average length (and/or other derivative statistics) of jobs received over some past time; the location or other origin of the first or second print job (i.e., the customer dissatisfaction with a delay will be less if the computer sending the job is physically far away from the printer 10); or some other identifier of the first or second print job (such as a job effectively indicated as low-priority). Also, if the first job is a copy job, there is likely to be a more noticeable customer dissatisfaction if there is a noticeable delay in the time of the output sheet. Of course, if the printer 10 is already in active mode when the first print request is received, the method of FIG. 2 need not be used.

Although the method illustrated in FIG. 2 is generalized for a change from an inactive mode of either type, warm-up or cycle-in, there may exist within a control system 12 a plurality of similar methods, with different criteria and differently-determined delay periods, one for each type of change.

Although the method illustrated in FIG. 2 specifies that the control system 12 will begin changing from an inactive to active mode if two print jobs are requested within a time period of predetermined duration, it is conceivable that a higher standard, such as accumulating three or more print jobs before ending the delay period, could be provided.

As used herein, the term "print request" shall mean any request of the printer 10 to output prints from any source, including print jobs, copy jobs, facsimile jobs, etc.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A method of operating a digital printer, the digital printer accepting data relating to a document to be printed, and outputting a print related to the data, the digital printer being operable in an inactive mode and an active mode, comprising:

in response to receiving a first print request, the digital printer delaying beginning switching from the inactive mode to the active mode, for a delay period of predetermined duration; and in response to receiving a second print request during the delay period, the digital printer beginning switching from the inactive mode to the active mode substantially immediately.

2. The method of claim 1, the active mode being at least partially characterized by a motor within the printer running at a predetermined speed.

3. The method of claim 1, the active mode being at least partially characterized by a sheet being drawn to a predetermined position within the printer.

4. The method of claim 1, the active mode being at least partially characterized by a fuser within the printer reaching a predetermined temperature.

5. The method of claim 1, the active mode being at least partially characterized by an ink heater within the printer reaching a predetermined temperature.

6. The method of claim 1, the active mode being at least partially characterized by a device within the printer reaching a predetermined potential.

7. The method of claim 1, the active mode being at least partially characterized by a processor associated with the printer initiating operation.

8. The method of claim 1, further comprising selecting a duration of the delay period.

9. The method of claim 8, further comprising selecting a duration of the delay period, based at least partially on a past behavior of print requests.

10. The method of claim 8, further comprising selecting a duration of the delay period, based at least partially on analyzing lengths of preceding print requests.

11. The method of claim 8, further comprising selecting a duration of the delay period, based on a time of day.

12. The method of claim 8, further comprising selecting a duration of the delay period, based on an origin of the first print request.

13. The method of claim 8, further comprising selecting a duration of the delay period, based on whether the first print request is a copy job.

14. The method of claim 1, wherein the delay period is less than thirty seconds.

* * * * *